US006089976A

United States Patent [19]

Schneider et al.

[11] Patent Number: 6,089,976

[45] Date of Patent: Jul. 18, 2000

[54] GAMING APPARATUS AND METHOD INCLUDING A PLAYER INTERACTIVE BONUS GAME

[75] Inventors: Richard Jay Schneider; Rex Carlson, both of Las Vegas, Nev.

[73] Assignee: Casino Data Systems, Las Vegas, Nev.

[21] Appl. No.: 08/951,170

[22] Filed: Oct. 14, 1997

[51] Int. Cl.[7] ..... A63F 9/22

[52] U.S. Cl. ..... 463/16; 273/138.1; 273/143 R

[58] Field of Search ..... 463/16, 17, 18, 463/19, 20, 12, 13; 273/143 R, 138.1, 139

[56] References Cited

U.S. PATENT DOCUMENTS

| | | | |
|---|---|---|---|
| 4,582,324 | 4/1986 | Koza et al. . | |
| 4,679,143 | 7/1987 | Hagiwara . | |
| 4,695,053 | 9/1987 | Vazquez et al. . | |
| 4,871,171 | 10/1989 | Rivero . | |
| 5,152,529 | 10/1992 | Okada . | |
| 5,318,298 | 6/1994 | Kelly et al. . | |
| 5,393,057 | 2/1995 | Marnell, II . | |
| 5,409,225 | 4/1995 | Kelly et al. . | |
| 5,437,451 | 8/1995 | Fulton . | |
| 5,560,603 | 10/1996 | Seelig et al. . | |
| 5,816,918 | 10/1998 | Kelly et al. | 463/16 |
| 5,855,514 | 1/1999 | Kamille | 463/17 |

FOREIGN PATENT DOCUMENTS

| | | |
|---|---|---|
| 5-131044 | 5/1993 | Japan . |
| 2 072 395 | 4/1981 | United Kingdom . |
| 2 083 936 | 3/1982 | United Kingdom . |
| 2 222 712 | 3/1990 | United Kingdom . |

OTHER PUBLICATIONS

Atronic Casino Technology sabs brochure copyright Oct. 1995.

*Primary Examiner*—Valencia Martin-Wallace
*Assistant Examiner*—John M. Hotaling, II
*Attorney, Agent, or Firm*—Bernhard Kreten

[57] ABSTRACT

A gaming apparatus and method including a primary game and a player interactive bonus game actuated by a qualifying outcome of the primary game and including a bonus award display showing a multiplicity of images displayed on a video monitor from which a player selects until achieving a pair of matched bonus awards.

13 Claims, 7 Drawing Sheets

GAMING APPARATUS AND METHOD INCLUDING A PLAYER INTERACTIVE BONUS GAME

FIELD OF THE INVENTION

The following invention relates generally to a method and apparatus for a gaming instrumentality which accepts wagers from a player. More particularly, the instant invention is directed to a method and apparatus for a video gaming machine including a primary game and a player interactive bonus game enabled upon a qualifying basis.

BACKGROUND OF THE INVENTION

The quest for gaming instrumentalities which will provide greater game interest and entertainment among players who wager is an ongoing odyssey. Gaming instrumentalities, particularly "progressive" type slots machines have provided a two tiered system in an attempt to continuously stimulate players to play a primary game in hopes of winning an extraordinary progressive jackpot. However, these types of gaming machines do not vary significantly from their predecessors and can fail to maintain player stimulus as a result of the lack of interaction the player has with the game in attempting to win the progressive jackpot. As a consequence, players can become disinterested in the gaming experience and gain a perception of being a passive observer of the progressive jackpot. Furthermore, after a progressive jackpot has built up to an extraordinary level and has been awarded to a player, there is a sharp drop off in the stimulus provided to players by these progressive types of machines until the pool of money builds back up.

First and second tiered games are also known on stand alone machines or in conjunction with a cluster of machines. For example, the patent to Marnell, II (U.S. Pat. No. 5,393,057) teaches the use of a poker game or reel game for the primary game and a bingo type game as a secondary game. Certain outcomes from the primary game are reflected in the secondary game and, upon the occurrence of orienting the reflected values from the first game to the second game in a pre-agreed upon pattern (resulting in bingo), a secondary award is made to one or more players responsible for the "bingo". Thus, these types of games also fail to maintain player stimulus as a result of the player being a passive observer of the secondary game.

Thus, it would be highly desirable for a casino to have a gaming machine which provides creative interaction between a player and a game such that the player is being stimulated by active participation in the game while simultaneously anticipating an increased payout in terms of a monetary value.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 4,582,324 | April 15, 1986 | Koza, et al. |
| 4,679,143 | July 7, 1987 | Hagiwara |

-continued

| | | |
|---|---|---|
| 4,695,053 | September 22, 1987 | Vazquez, et al. |
| 4,871,171 | October 3, 1989 | Rivero |
| 5,152,259 | October 6, 1992 | Okada |
| 5,318,298 | June 7, 1994 | Kelly, et al |
| 5,393,057 | February 28, 1995 | Marnell, II |
| 5,409,225 | April 25, 1995 | Kelly, et al. |
| 5,437,451 | August 1, 1995 | Fulton |
| 5,560,603 | October 1, 1996 | Seelig, et al. |

FOREIGN PRIOR ART

| PATENT NO. | ISSUE DATE | APPLICANT |
|---|---|---|
| UK 2 072 395 | April 30, 1981 | Kennedy, et al. |
| UK 2 083 936 | March 31, 1982 | Coin Operated Parts Service |
| UK 2 222 712 | March 14, 1990 | Barcrest Limited |
| JP 5-131044 | May 28, 1993 | Jikoki, et al. |

The prior art listed above catalog the prior art of which the applicant is aware.

SUMMARY OF THE INVENTION

The instant invention is distinguished from the known prior art in a multiplicity of ways. For one thing, the present invention provides a gaming machine which allows a player to become an active participant by directly interacting with a secondary game which is enabled upon a qualifying outcome of a primary game or on a random basis earned in the primary game. Thus, the instant invention provides interaction between the player and the game such that the player is being stimulated by active participation in the game while simultaneously anticipating a secondary bonus award.

In addition, the instant invention provides a touch sensitive screen to allow the player to directly interact with the gaming machine in order to obtain a secondary bonus award. Furthermore, the instant invention provides a bonus award screen comprised of a multiplicity of images from which the player is allowed to select from by touching the image on the touch screen. The instant invention allows the player to select, by touch, the images one at a time and once selected, an initially obscured bonus amount is revealed. The player continues to select images until two matching bonus amounts are revealed and that corresponding bonus amount is then paid to the player or incremented on a credit meter.

A further element of distinction involves the provision of the primary game and the interactive bonus award means being displayed on a single video monitor. Thus, the single monitor allows the player to remain focused since the primary game and the bonus award means are on the same viewing field which does not require the player's attention to be diverted from one area to another area. By having both games within a comfortable field of vision, the player is less likely to be distracted and become disinterested in game play as a result of the bonus awards means being in a field of vision remote from the areas of principle focus by the player.

In a preferred form of the invention, the gaming machine includes a single video monitor to display the primary game, preferably in the form of a reel style slot game, and the interactive bonus award means or game. Assume, for example, that the primary game is draw poker and that the interactive bonus game is only enabled upon a qualifying hand earned in the primary game. Thus, upon earning a qualifying hand through playing draw poker, the video monitor displays a multiplicity of choices on the screen, preferably in the form of a matrix or array of choices, in which the choices have values which are initially obscured from the view of the player. In the present form of the invention, a touch sensitive screen is employed so that the player is allowed to select from the multiplicity of choices on the screen by touching. Preferably, the player is allowed to select by touching the screen, plural occluded values, selecting them one at a time. Upon touching the screen, a bonus amount associated with the selection made by the player is revealed to the player. The player continues to make selections one at a time by touching the screen until two matching bonus amounts are revealed. A credit meter is then incremented or the player is paid directly based on the value of one of the two matching bonus amounts. The player is then asked for a subsequent wager. In a preferred form of the invention, the choices are in the form of stars and the underlying values revealed to the player reflect a specific number of coins to be paid upon a match.

More specifically, a player places a wager and plays a primary game having a resultant outcome which is compared to winning combinations on a pay table. If a winning combination is not obtained on the primary game the player is asked for a subsequent wager. If a winning outcome is obtained on the primary game a credit meter is incremented and the game determines whether the player has placed a "max" (maximum) bet and whether the outcome of the primary game is a qualifying one. If the outcome is not a qualifying outcome the player is asked for a subsequent wager. If the outcome is a qualifying one and a max bet has been placed a secondary bonus display replaces the primary game display and allows the player to interact with the gaming machine by touching images on the screen to reveal bonus amounts associated therewith. The player continues to touch images one at a time until two matching bonus amounts are obtained. A credit meter is then incremented or the player is paid directly based on the matching bonus amounts. The player is then asked for a subsequent wager.

Thus, a first award is made to the player after the primary game has been finalized and second award is also made on the bonus game based on selecting and matching bonus amounts. Thus, the player has two opportunities to win: the first opportunity comes from comparing an outcome from a reel style slot game against a known pay table and the second involves matching two selections should the player qualify on the primary game thus providing the potential for a second payout.

OBJECTS OF THE INVENTION

Accordingly, a primary object of the present invention is to provide a new, novel and useful gaming apparatus and method therefore.

A further object of the present invention is to provide an apparatus and method as characterized above which is easy to understand and enjoyable to use.

A further object of the present invention is to provide an apparatus and method as characterized above which stimulates gaming activity.

A further object of the present invention is to provide an apparatus and method as characterized above which includes player interactive bonus award means.

These and other objects will be made manifest when considering the following detailed specification when taken in conjunction with the appended drawing figures.

DESCRIPTION OF PREFERRED EMBODIMENTS

Figure 1:
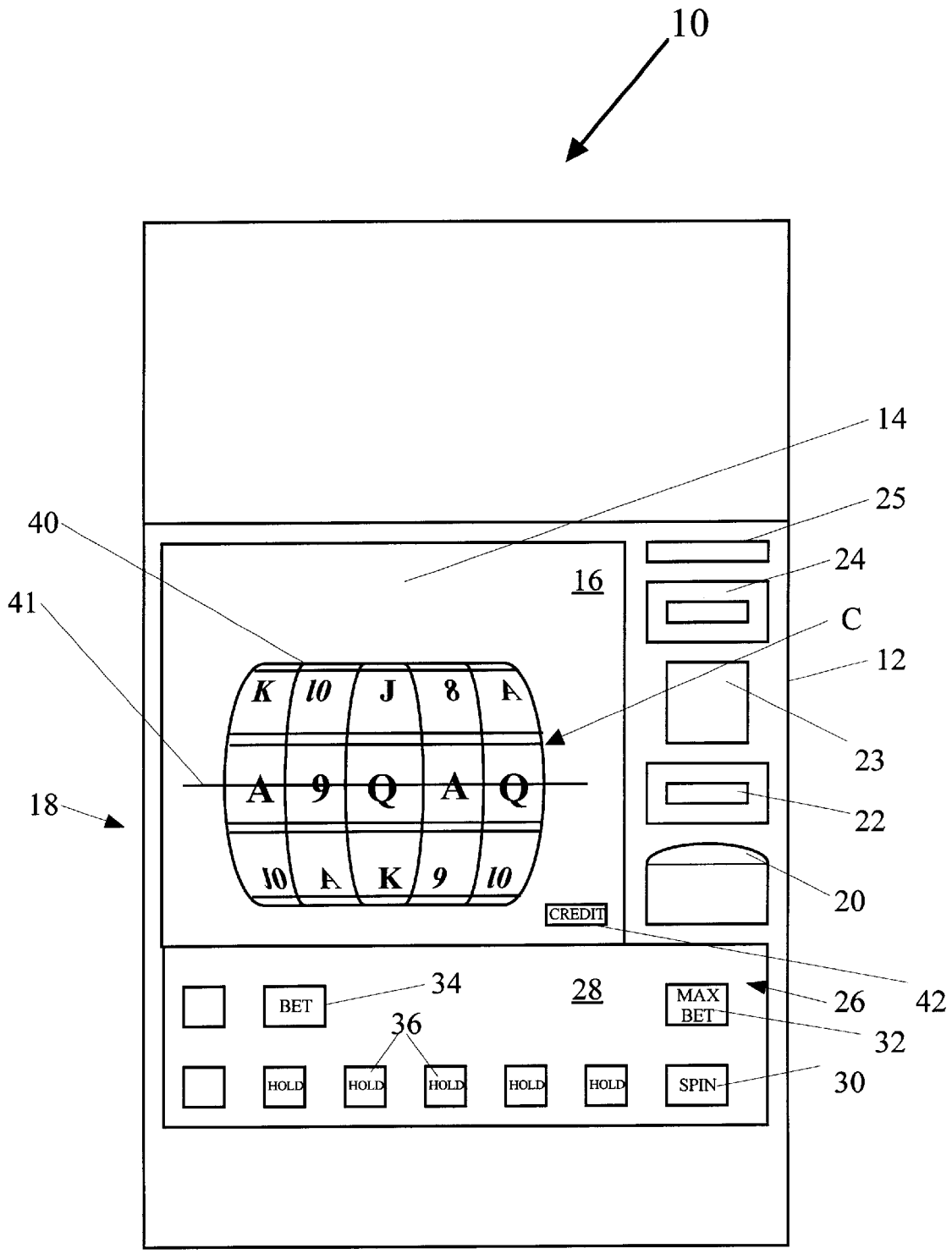
FIG. 1 is a visual depiction of a gaming apparatus having a video monitor showing a reel-type slot game.

Considering the drawings, wherein like reference numerals denote like parts throughout the various drawing figures, reference numeral 10 is directed to the apparatus and method according to the present invention and as shown in the drawing figures.

In its essence, the gaming machine 10 includes a housing 12 having a video monitor 14 deployed therein and including a touch sensitive screen 16. In addition, machine 10 includes wagering input means 18 in the form of, for example, a coin slot 20, a currency slot 22, a card slot 24 and an associated alpha numeric pad 23 or the like. Furthermore, the machine 10 includes a plurality of decision related push buttons 26 disposed in a panel 28 and including a spin button 30 and bet switches 32,34. A primary game is initiated by a player establishing credit on the gaming machine 10 via either entering tokens, coins, currency or the like into the wagering input means 18 and making a wager via the bet switches 32,34. A bonus awards means is preferably automatically initiated through a qualifying outcome obtained via the primary game. Thus, if the outcome of the primary game is a qualifying outcome the display of the video monitor 14 transforms into the bonus award display 50 shown in FIG. 2.

Figure 2:
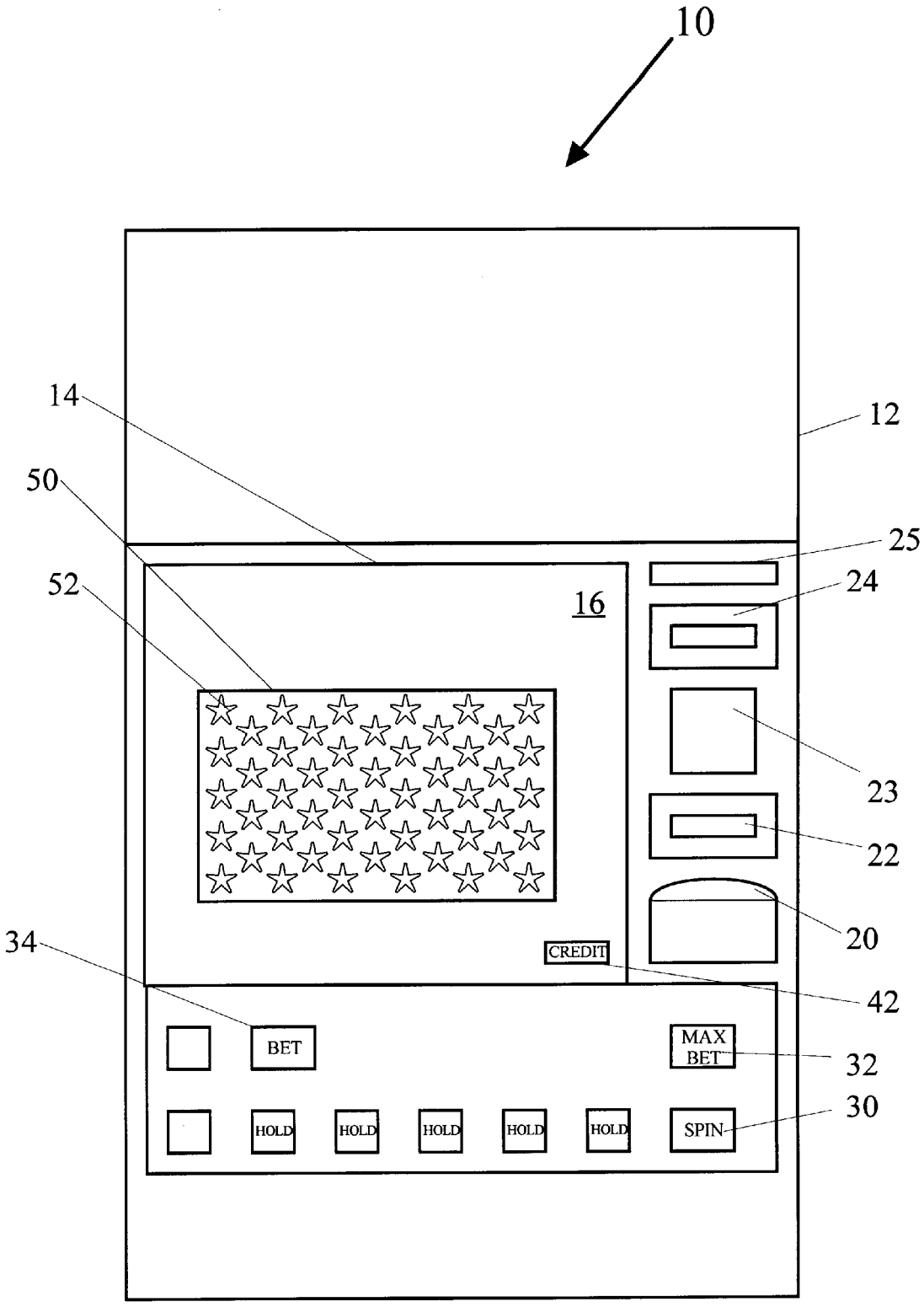
FIG. 2 is a visual depiction of the gaming machine shown in FIG. 1 having the video monitor displaying a plurality of images in the form of stars according to one form of the instant invention.
Figure 3:
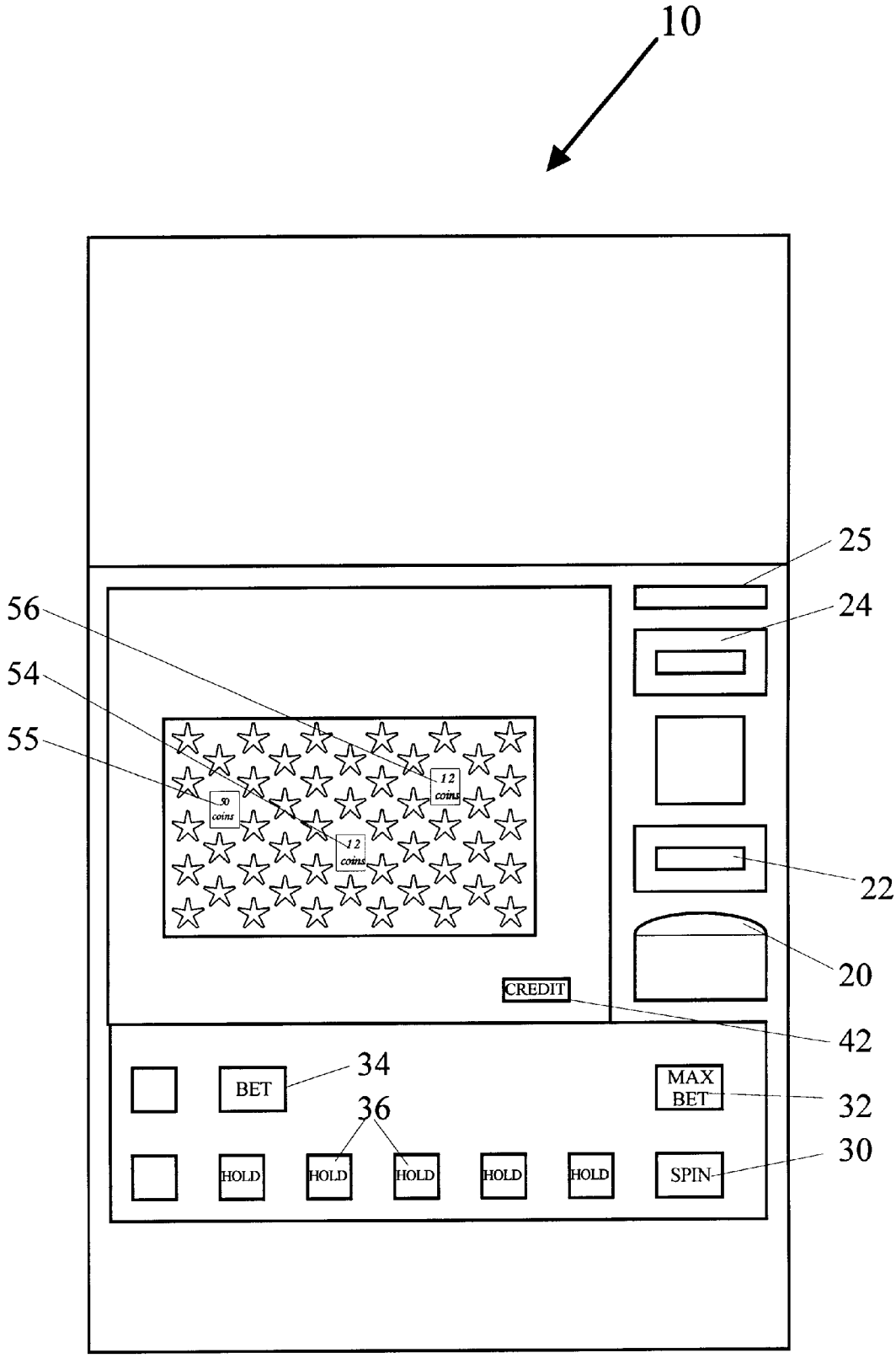
FIG. 3 is a visual depiction of the gaming machine having the video monitor showing bonus amounts associated with images which have been selected by a player.
Figure 4:
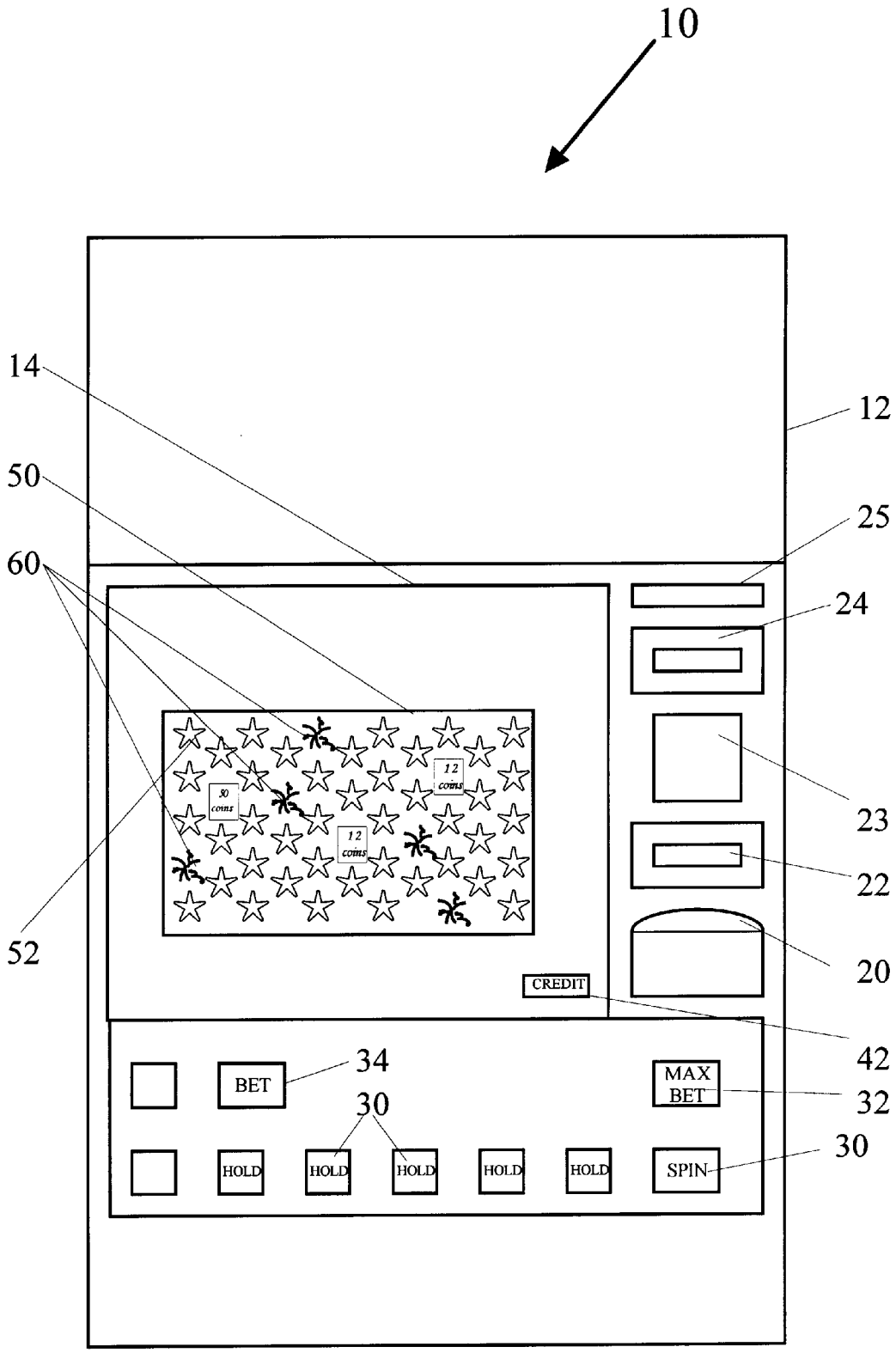
FIG. 4 is a visual depiction of the gaming machine having the video monitor showing a pair of matched bonus amounts revealed by player selection and having remaining images exploding.
Figure 5:
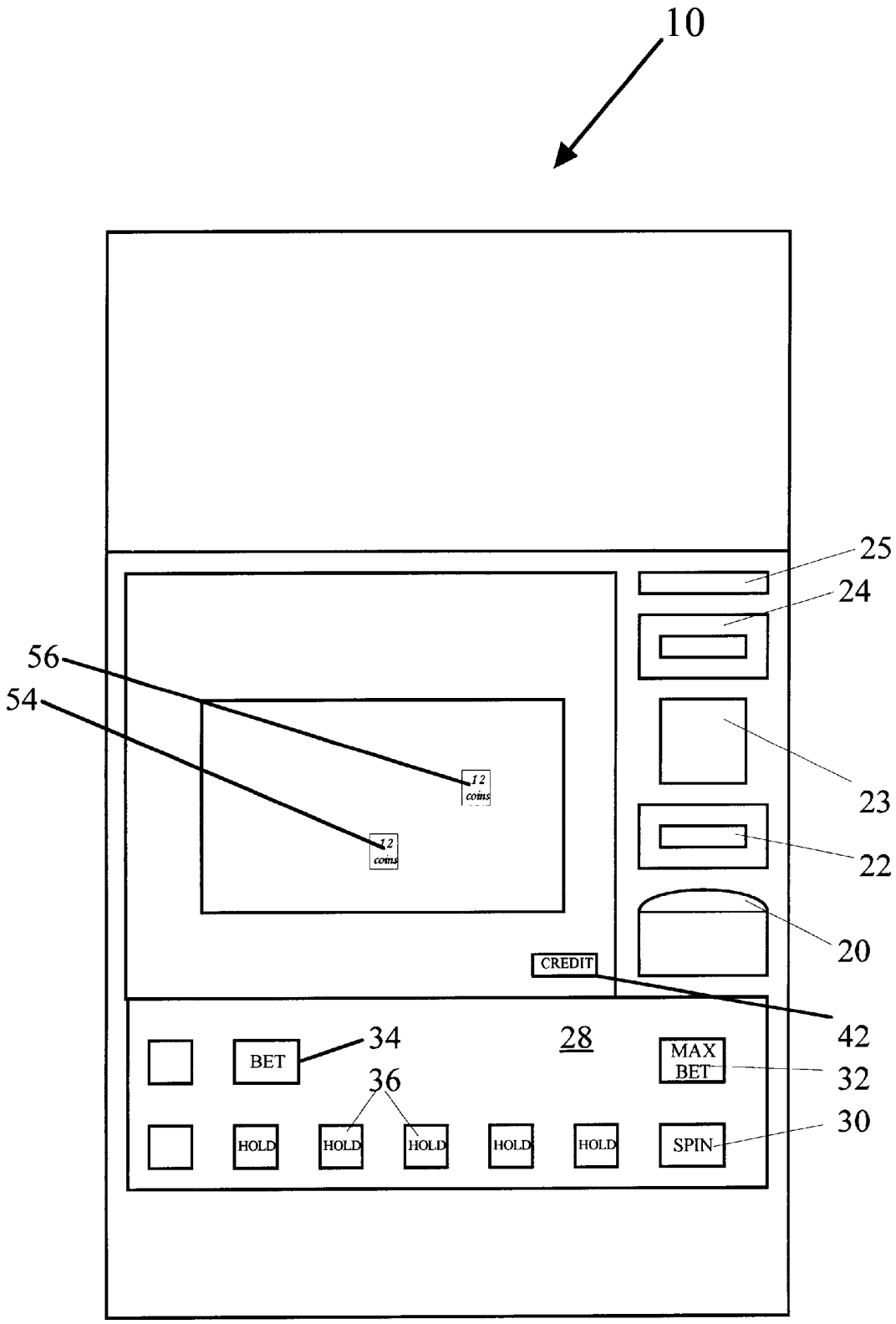
FIG. 5 is a visual depiction of the gaming machine having the video monitor showing the pair of matched bonus amounts remaining after all other images have exploded.

Referring to FIG. 2, the bonus award display 50 is comprised of a multiplicity of images 52 which have bonus amounts initially obscured form the view of the player. The player is instructed, by the video monitor 14 or by a LCD display means 25, to select images one at a time in an attempt to match at least two bonus amounts. Once an image is selected, the bonus amount associated with that image is revealed as shown in FIG. 3. The bonus amount is not paid out immediately. Instead, the player continues to select images until two matching bonus amounts are obtained. Referring to FIG. 4, once two matching bonus amounts are obtained the remaining images preferably dissipate in the form of explosions leaving only the two matching amount displayed on the video screen as shown in FIG. 5. The matching amount remaining on the video screen is correlative to the final bonus award added to a credit meter 42 or directly paid to the player.

Figure 6:
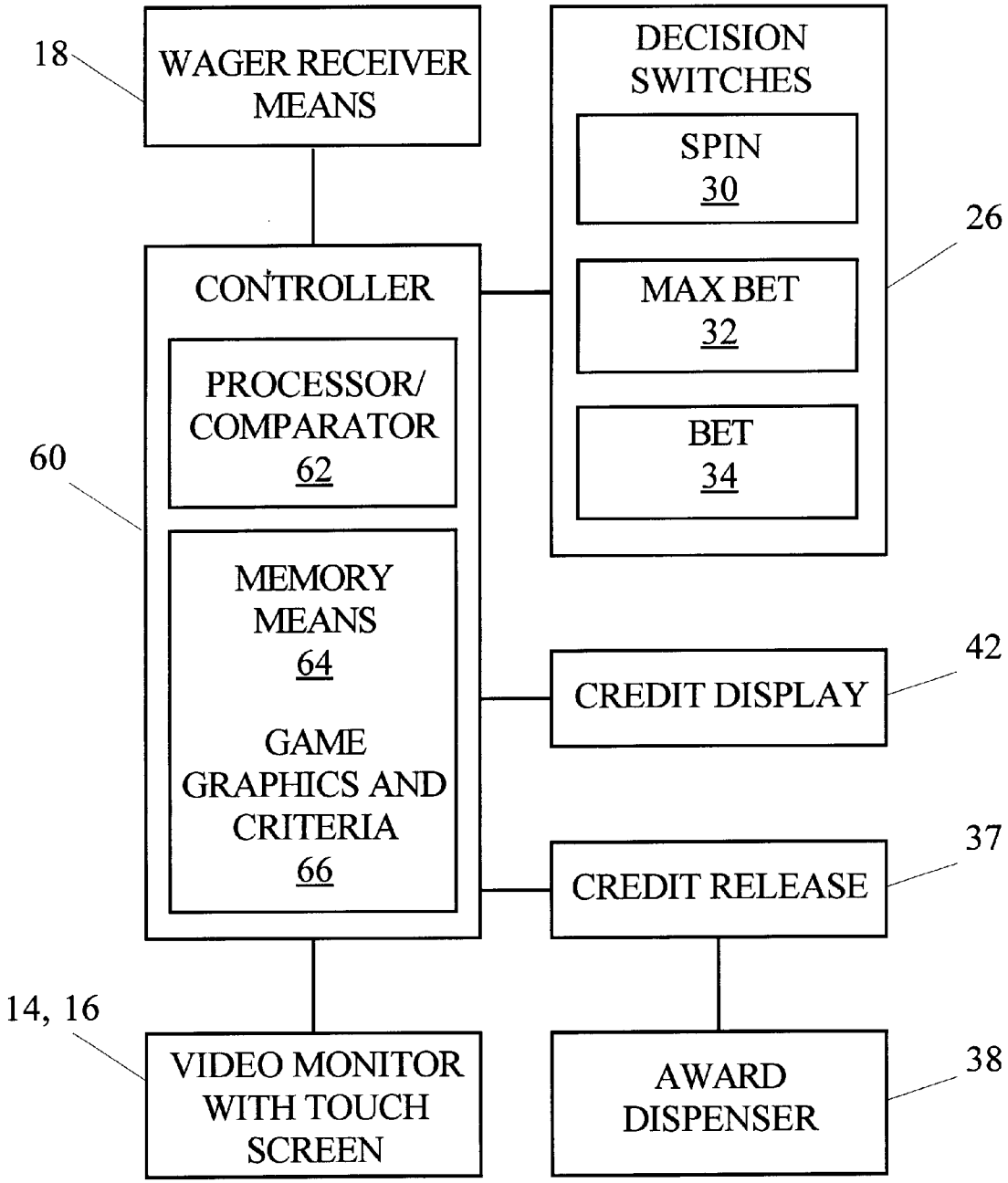
FIG. 6 is a general block diagram of the apparatus according to the instant invention.
Figure 7:
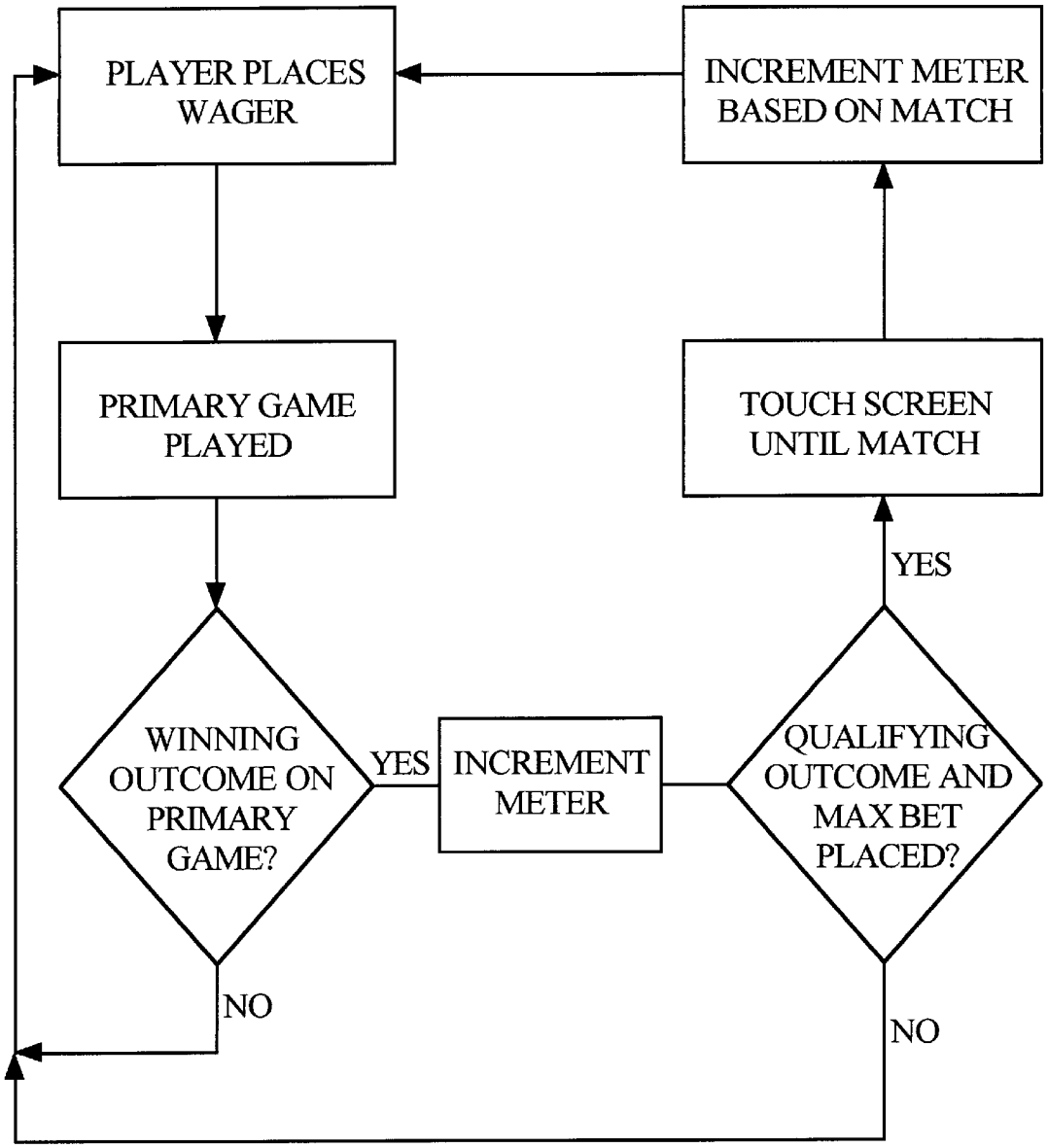
FIG. 7 is a flowchart of one method of gaming according to the instant invention.

More specifically, and referring to FIGS. 1, 6 and 7, one arrangement for playing the gaming machine 10 according to the apparatus and method of the present invention can be explored. A game controller 60 is operatively coupled to the video monitor 14, the wagering means 18 and the plurality of decision related push buttons or switches 26. The game controller 60 includes a processor/comparator 62 and a memory means 64 having game graphics and game criteria 66 stored therein. The game controller 60 initiates game play when the player establishes credit on the credit meter 42 by placing a wager via the wagering means 18 and actuating the spin switch 30 and/or actuating one or more of the bet switches 32,34. Preferably, the primary game is a video draw poker game incorporating a video depiction of five reels 40 having card symbols C displayed thereon. Once the game has been initiated, the video monitor 16 is set in motion and simulates five spinning reels 40. After the video reels 40 have stabilized, certain combinations of card symbols C will appear adjacent at least one win line 41. As is conventional in draw poker, the player is allowed to improve the hand by discarding certain cards and receiving replacements therefore. Preferably, the player actuates hold buttons 36 for holding a respective card symbol on a respective reel and respinning the reel(s) not held by actuation of the spin button 30. After the video reels 40 have again stabilized, the resulting combination of card symbols C appearing adjacent a win line 41 yield a score which is derived from a predetermined table of scores stored in memory means 64. Typically, if the combination of cards along the win line 41 correspond to a winning combination the player is played a corresponding amount. Typically, a predetermined number of coins or tokens are paid out via a credit release 37 releasing coins to an award dispenser 38 or a corresponding number of credits are incremented on the credit meter 42. Alternatively, the primary game can be a conventional video style three reel-type slot machine employing symbols in the form of bells, fruits, numbers, etc.

Referring to FIGS. 6 and 7, after a wager has been placed and the primary game has been played the resulting combination is compared to a pay table stored in memory means 64. If a winning combination is not obtained on the primary game the player is asked for a subsequent wager. If a winning outcome is obtained on the primary game the credit meter 42 is preferably incremented. Next, the gaming machine 10 determines whether the player has placed a max bet via the max bet button 32 and whether the outcome of the primary game is a qualifying one. If the outcome is not a qualifying outcome the player is asked for a subsequent wager. If the outcome is a qualifying one and a max bet has been placed the primary game display 40 shown in FIG. 1 transforms into the bonus award display 50 shown in FIG. 2. As shown in FIG. 2, a plurality of stars 52 are visually depicted on the screen 16. The player next selects a series of stars, one at a time, from a row and column matrix defining the bonus display. As shown, a matrix of fifty stars is shown as alternating offset columns including five stars and then four stars correlative to the stars of the United States flag. Other images, orientation of images and number of images are contemplated as being a part of the invention.

The bonus award display 50 replaces the primary game display and allows the player to interact with the gaming machine by touching images on the screen to reveal bonus amounts associated therewith. The player continues to touch images one at a time until two matching bonus amounts are obtained. A credit meter is then incremented or the player is paid directly based on the matching bonus amounts. The player is then asked for a subsequent wager.

Specifically, and referring to FIGS. 2 through 5, the bonus award video screen is comprised of a multiplicity of images in the preferred form of stars 50. The player is instructed to select images one at a time in an attempt to match at least two values. The player cannot initially discern the values of the stars on the bonus award display 50 because they are occluded, but must instead select the different stars in order to achieve a bonus award. FIG. 3 shows the effects of the player having made three selections on the screen 16 wherein a two of the selections form a match. The touch screen, when touched by the player can use graphic imagery to simulate the hidden bonus award values appearing within the selected star or replacing the selected star. The bonus amount value is not paid out immediately. Instead, the player continues to select images until two matching bonus amounts are obtained as shown in FIG. 3.

Referring to FIG. 4, once two matching bonus amounts are obtained the remaining images preferably dissipate in the form of explosions 60 leaving only the two matching amount displayed on the video screen 16 as shown in FIG. 5. The matching amount remaining on the video screen is correlative to the final bonus award and is preferably added to the credit meter 42 or directly paid to the player. The credit meter 42 will then be advanced as the result of having achieved a matching pair of bonus award values.

In use and operation, the gaming machine includes a single video monitor to display the primary game and the interactive bonus award game. Assume, for example, that the primary game is draw poker and that the interactive bonus game is only enabled upon a qualifying hand earned in the primary game. Thus, upon earning a qualifying hand through playing draw poker, the video monitor displays a multiplicity of choices on the screen, preferably in the form of a matrix or array of choices, in which the choices have values which are initially obscured from the view of the player. In the present form of the invention, a touch sensitive screen is employed so that the player is allowed to select from the multiplicity of choices on the screen by touching. Preferably, the player is allowed to select by touching the screen, plural occluded values, selecting them one at a time. Upon touching the screen, a bonus amount associated with the selection made by the player is revealed to the player. The player continues to make selections one at a time by touching the screen until two matching bonus amounts are revealed. A credit meter is then incremented or the player is paid directly based on the value of one of the two matching bonus amounts. The player is then asked for a subsequent wager. In a preferred form of the invention, the choices are in the form of stars and the underlying values revealed to the player reflect a specific number of coins to be paid upon a match.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming apparatus comprising in combination:

wager input means;

a processor enabled by said by wager input means;

a display means enabled by said processor upon activation of said processor by said wager input means;

an outcome generated by said processor and depicted by said display means;

a bonus award means operatively enabled by a certain said outcome, said bonus award means including a plurality of choices disposed on a touch sensitive panel wherein said bonus award means is comprised of a multiplicity of images including means to have bonus amounts initially obscured from the view of the player, wherein said plurality of choices on said touch sensitive panel include inhibit means to allow selection only one at a time including means to sense a match of at least two bonus amounts, and an award increment means incrementing in value based upon two player selected matching choices.

2. The apparatus of claim 1 wherein said plurality of choices on said touch sensitive panel are in the form of stars.

3. The apparatus of claim 2 wherein said plurality of choices on said touch sensitive panel are in the form of a matrix of fifty said stars.

4. The apparatus of claim 3 wherein said matrix includes offset rows and columns in which said fifty stars are disposed.

5. The apparatus of claim 4 wherein said outcome depicted by said display means is transformed into said bonus award means displaying said stars.

6. The apparatus of claim 1 including means to reveal said bonus amount associated with each said choice when selected responsive to stimulus on said touch sensitive panel.

7. The apparatus of claim 6 including means to dissipate a plurality of non matching remaining images simulative of explosions, and means to retain at least one pair of matching bonus amount displayed on said display means.

8. A gaming apparatus comprising, in combination:

a first chance means displayed on a video monitor and including a plurality of outcomes enabled by a means for receiving a wager;

at least one bonus award means replacing said first chance means on said video monitor enabled by said first chance means upon the occurrence of a specific outcome and said wager being a maximum wager;

said bonus award means including means to generate a multiplicity of images having obscured value means from which the player selects from via a touch sensitive panel operatively coupled to said video monitor, said obscured value means responsive to touching on said touch sensitive panel by unobscuring a value of one image when touched, and means for granting a bonus award based upon two identical values being exposed.

9. A gaming machine method, the steps including;

receiving a wager;

displaying a primary game on a video monitor;

accepting a player activation for playing the primary game on the video monitor;

displaying an outcome of the primary game;

evaluating the outcome of the primary game;

transforming said primary game on said video display means with a bonus award means upon an occurrence of a qualifying outcome of the primary game, the bonus award means displaying a multiplicity of images;

selecting one image at a time by touching said video display means;

revealing a bonus amount associated with each image selected by a player;

awarding the player a bonus amount correlative to a revealed bonus amount only when two amounts obtained by player selection are displayed which identically match.

10. The method of claim 9 wherein the step of displaying a multiplicity of images includes the step of displaying a plurality stars on a touch sensitive panel.

11. The method of claim 10 wherein the step of displaying a plurality stars on said touch sensitive panel includes the step of displaying a matrix of fifty said stars.

12. The method of claim 11 wherein the step of displaying said matrix of fifty said stars includes the step of displaying said matrix as a set of offset rows and columns in which said fifty stars are disposed.

13. The method of claim 9 further including the step of simulating explosions of images with the exception of at least one pair of images revealing matching bonus amount displayed on said video means as a function of player selection.

* * * * *